United States Patent [19]

Lepetic

[11] 4,229,287

[45] Oct. 21, 1980

[54] TIN FLOTATION

[75] Inventor: Vuko M. Lepetic, Iselin, N.J.

[73] Assignee: Engelhard Minerals & Chemicals Corporation, Edison, N.J.

[21] Appl. No.: 966,485

[22] Filed: Dec. 4, 1978

[51] Int. Cl.[2] ..... B03D 1/04

[52] U.S. Cl. ..... 209/167

[58] Field of Search ..... 209/166, 167, 11

[56] References Cited

U.S. PATENT DOCUMENTS

| | | | |
|---|---|---|---|
| 1,492,904 | 5/1924 | Solmon | 209/166 |
| 1,972,588 | 9/1934 | Hansen | 209/166 |
| 2,120,485 | 6/1938 | Clemmer | 209/167 |
| 2,202,601 | 5/1940 | Ried | 209/166 |
| 2,557,455 | 6/1951 | Moyer | 209/166 |
| 2,607,479 | 8/1952 | Bates | 209/166 X |
| 2,741,364 | 5/1956 | Wilson | 209/11 |
| 3,314,537 | 4/1967 | Greene | 209/166 X |
| 3,337,048 | 8/1967 | Mercade | 209/166 X |
| 3,469,693 | 9/1969 | Arbiter | 209/166 |
| 3,482,013 | 8/1969 | Mercade | 209/166 X |
| 3,635,337 | 1/1972 | Mercade | 209/166 X |
| 3,830,366 | 8/1974 | Day | 209/166 |
| 3,915,391 | 10/1975 | Mercade | 209/166 X |
| 3,929,629 | 12/1975 | Griffith | 209/167 |

FOREIGN PATENT DOCUMENTS

| | | | |
|---|---|---|---|
| 122177 | 9/1946 | Australia | 209/166 |
| 168927 | 9/1921 | United Kingdom | 209/166 |
| 538530 | 8/1941 | United Kingdom | 209/166 |
| 584206 | 1/1947 | United Kingdom | 209/166 |

OTHER PUBLICATIONS

Chem. Abst., 73, 1970, 101144n.
Chem. Abst., 82, 1975, 33609b.
Chem. Abst., 75, 1971, 39080z.

*Primary Examiner*—Robert Halper
*Attorney, Agent, or Firm*—Inez L. Moselle

[57] ABSTRACT

Tin values in the form of cassiterite ($SnO_2$) are recovered from aqueous pulps of finely divided cassiterite-bearing ore, preconcentrate or concentrate by froth flotation. The ore pulps are deslimed thoroughly, partially or not at all. Slimes, gangue or waste minerals in the pulps are selectively depressed by use of a metal salt/silicate reagent combination. The cassiterite is floated at a mildly acidic to neutral pH, generally in the range of about 5 to 6, by one and/or more highly selective tin collectors such as sulfosuccinamates, aspartates, phosphonates, etc., at environmental or, preferably, elevated pulp temperature. Flotation machine impeller speeds are within conventional range or higher, preferably the latter. The cleaning of the thus-produced cassiterite rougher flotation concentrate is performed after an additional (secondary) conditioning step whereby an additional depressant, such as tannic acid, sulfuric acid, sodium fluosilicate, sodium lignin sulfonate or activated charcoal is used.

12 Claims, 1 Drawing Figure

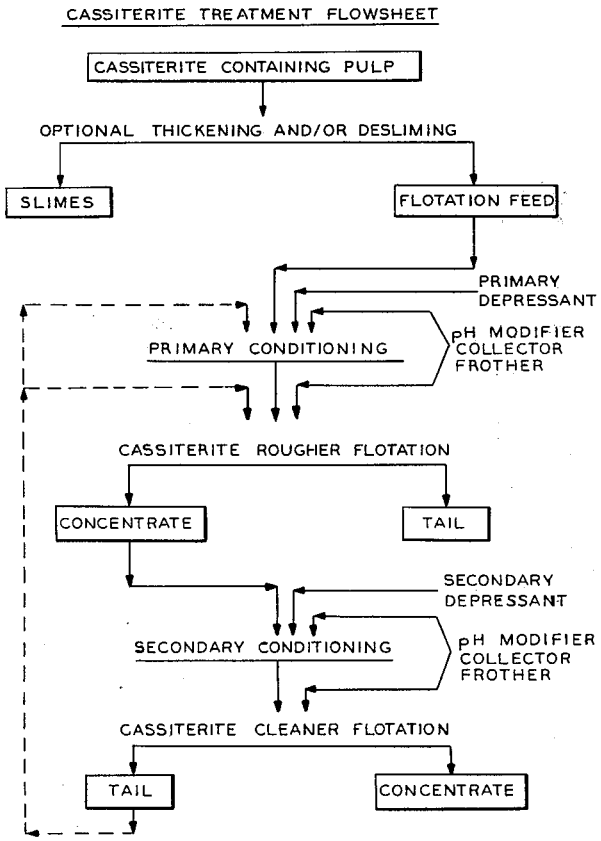

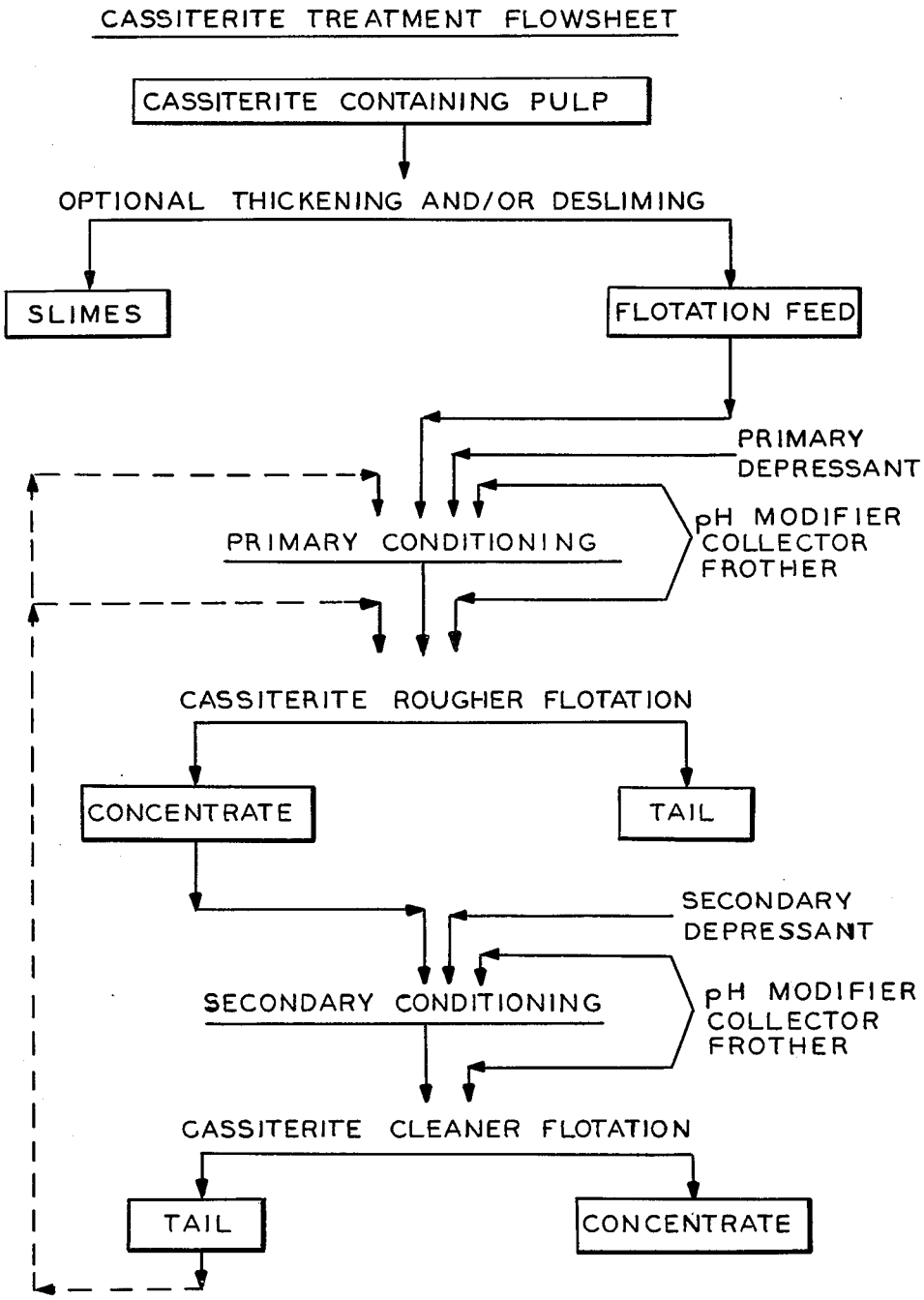
CASSITERITE TREATMENT FLOWSHEET
CASSITERITE CONTAINING PULP
OPTIONAL THICKENING AND/OR DESLIMING
SLIMES
FLOTATION FEED
PRIMARY DEPRESSANT
pH MODIFIER
COLLECTOR
FROTHER
PRIMARY CONDITIONING
CASSITERITE ROUGHER FLOTATION
CONCENTRATE
TAIL
SECONDARY DEPRESSANT
pH MODIFIER
COLLECTOR
FROTHER
SECONDARY CONDITIONING
CASSITERITE CLEANER FLOTATION
TAIL
CONCENTRATE

TIN FLOTATION

FIELD OF INVENTION

The invention relates to the beneficiation of tin-containing ores, ore preconcentrates or ore concentrates to recover the mineral cassiterite, which is stannic oxide in chemical composition and is the principal source of tin. The invention relates particularly to the froth flotation concentration of tin from low grade, fine grain cassiterite ores.

Cassiterite is found in either alluvial or lode deposits. The cassiterite from the alluvial deposits as well as the coarse grained cassiterite from the lode deposits is usually concentrated by methods based on the relatively high specific gravity of the mineral. These gravity concentration methods are highly efficient in coarse particle size ranges. However, there is a lower limit of the particle size which can be effectively treated by gravity concentration because the fine particles, even of high specific gravity, have relatively slow settling rates. Consequently, gravity separation methods become inefficient below about 50 microns, and completely ineffective below about 20 microns.

The limited capability of gravity methods to concentrate cassiterite has become increasingly evident as the high grade, coarse grain ore bodies have become relatively depleted and more tin must now be produced from relatively low grade, fine grain cassiterite ore deposits. The limitations of gravity methods have been demonstrated by the very substantial losses of the tin values in finer particle sizes which, as noted above, are not amenable to such separation techniques.

In view of the above, froth flotation of fine cassiterite has been investigated for a number of years and in some instances applied commercially as a method for the recovery of fine tin bearing particles into concentrates.

In most of the earlier attempts to beneficiate cassiterite by froth flotation, collectors of the fatty acid or fatty acid salt type (so-called "soaps) have been used. (See J. M. Patek, "Soap Flotation", EMJ March 1934, p. 125. These attempts had very limited success: recoveries and concentrate grades were low and operating conditions difficult, particularly in the presence of either contaminating minerals or various undesirable cations (Fe, Ca, Mg) in mill water, or both. The use of commercial flotation for tin ores on a broader scale began about ten years ago. Now, there are commercial flotation plants operating in Australia, Bolivia, England, German Democratic Republic (GDR), South Africa and the USSR.

Generally, the reagent systems for the froth flotation of cassiterite as practiced in commercial plants include several reagent groups known as collectors, depressants and pH modifiers. Among the cassiterite collectors, tetrasodium octadecyl sulfosuccinamate (U.S. Pat. No. 3,469,693) manufactured under the trade names of Aerosol 22, Aeropromoter 845 or 860 (American Cyanamid Co., USA) or Procol CA540 (Allied Colloids Ltd., U.K.) appears to be widely used in Bolivia. Phosphonates are preferred in GDR and South Africa. Salts of arsonic acid are used in Australia, but an aspartate (S-3903, manufactured by American Cyanamid Co., USA) was also tested. In addition to the above, hydroxamate and ethyl hexyl phosphoric acid were tried in the USSR and phosphatides were a subject of Canadian research. The latter three collectors have not been commercially used. Contradictions regarding the effectiveness of the above collectors do exist and it appears that different collectors are suitable for different types of ores, i.e. types of cassiterite and types of gangue minerals.

Silicates, fluorides and fluosilicates appear to be most widely used depressants in cassiterite flotation. Citric acid alone or with fluosilicate is used in Bolivia. In the USSR, oxalic acid is used in addition to the above.

With regard to the pH value of the cassiterite flotation pulps, one will realize that the pH depends strongly on the collector system of choice. Oleic and other fatty acids require a 7.5 to 8.5 pH level in most cases. The phosphonic acids are used in GDR at a pH of 6.0. The phosponates employed in South Africa call for the 4.5 to 5.5 pH range, while the arsonates used in Australia required the pH range from 5.0 to 5.5. The sulfosuccinamate collection as practiced in Bolivia requires a low pH range of 2 to 3, while in England the same collector yielded improved results when employed at the higher pH of 5.8 and combined with an organic depressant (DA 811, manufactured by Allied Colloids Ltd., U.K., U.K. Pat. No. 1,452,605). The recently used aspartate collector (S-3903) has been reported to be most efficient at low (2–3) pH values. The reagents used for pH modification are those alkaline compounds and mineral acids common to other commercial flotation systems.

Two important conditions prior to the cassiterite flotation have to be satisfied in order to produce adequate concentrate grades and recoveries. Firstly, the sulfides, which may be present in the ore, have to be removed. The latter is accomplished fairly simply by the means of the techniques commonly known and practiced in the art. Secondly, it has been generally accepted that cassiterite bearing pulps have to be deslimed, i.e., very finely sized particles rejected prior to the flotation of cassiterite.

While considerable research and development efforts have been aimed at improving flotation technology to recover cassiterite, all of the flotation systems heretofore proposed or actually used have one or more significant detractive features. The major common disadvantage of all present commercial processes has been their inability to treat the given material unless thoroughly deslimed. Thus, in all commercial flotation plants, feeds to the tin flotation, from which the sulfides have been removed, are invariably and thoroughly deslimed at about 7 microns or coarser, as the presently used reagent systems cannot economically and practically be applied to the feeds containing the slimes. The slimes are rejected as waste, and in numerous cases very substantial tin losses occur in those very fine sizes. These losses in the slimes of the existing flotation operations are an economic challenge, particularly at current tin prices. In Bolivia, the tin slime losses for four plants are reported as 39, 16, 46 and 10 percent of the available tin in the feed. (See Romero, R. L., et al. AIME, SME preprint 71-B-32, 1971.) In England and Australia these losses are 50 and 20 percent of the total plant losses. (See Moncrief, A. G., et al., Trans IMMA, Vol. 86, April 1977, pp. 455–60.) Attempts to retreat these slimes by flotation have, in several cases reported, led to unacceptable concentrate grades and recoveries.

Another disadvantage of all present operations is the lack of an efficient fine gangue and slimes depressant which would allow cassiterite flotation from undeslimed or only very lightly or partially deslimed pulps, as opposed to the thoroughly deslimed pulps used in commercial tin flotation operations at the present time.

Due to the lack of such a depressant, another operational difficulty is common to many cassiterite flotation systems, namely, substantial circulating loads within the flotation system, often resulting in substantial recovery losses in order to maintain the desired grade of the concentrate.

Yet another disadvantage of cassiterite flotation up to now is that highly acidic pulps (pH 2–3) are required with the highly selective tin collectors (sulfosuccinamate in Bolovia or aspartate in Australia). Higher acid consumption and equipment corrosion are among the adverse effects of the low pH pulp when practicing prior art tin flotation technology. The use of higher pulp pH values calls for disadvantageously expensive collector reagents such as phosphonates and particularly arsonates, the latter being particularly undesirable due to their toxicity. The use of sulfosuccinamate at a more acceptable pH of about 5.5 to 6.0 in combination with the organic depressant DA 811 as mentioned before, is reported to have met with varying degrees of success, the variation largely being caused by the changing nature of the ore. Such use does not appear to have met with wide approval.

A cassiterite flotation method utilizing undeslimed flotation pulps has been proposed previously. The method features the use of a mixture of sulfosuccinamate and an oil and the use of high energy agitation of the pulp "to cause an increase in temperature" during the conditioning step and prior to actual flotation. The collector reagent as proposed is not sufficiently selective due to the admixed oil. Another very substantial disadvantage of the process described in the proposed method is a highly expensive energy input necessary to cause pulp temperature increase as a consequence of high speed agitation.

SUMMARY OF THE INVENTION

A general objective of the present invention is to design a simple and inexpensive and yet efficient and practical cassiterite flotation system.

One particular objective of the present invention is to provide a system for the froth flotation of cassiterite in which recovery of very fine tin particles, now lost and rejected as slimes, will be substantially enhanced over the present practices. Yet another objective of the present invention is to provide a process for cassiterite flotation that employs a gangue mineral depressant which will dramatically improve the selectivity of cassiterite flotation over the presently known systems. Still another objective of the present invention is to provide for the use in tin flotation of additional (secondary) depressants to further increase the sharpness of the gangue minerals separation from the cassiterite, without adversely affecting the grade and recovery of the latter. Yet another objective of the invention is to introduce an additional (secondary) conditioning step with additional (secondary) depressants to still further improve the separation of the cassiterite from the gangue.

An additional objective of the invention is to create a tin flotation system where at least the rougher flotation process is carried out at a desirable pH value of the pulp of about 5 to 6 instead of the previously discussed range of pH 2 to 3.

Another objective of the invention is to improve the flotation of cassiterite by increasing the temperature of the flotation pulp by relatively inexpensive external means. And another objective of the invention is to further improve the flotation of the finest cassiterite particles by subjecting them to vigorous mixing in the flotation machine itself, thus securing higher tin recovery.

Practice of embodiments of the present invention fulfills one or more of the objectives above-mentioned and represents a very substantial improvement in the treatment of cassiterite by froth flotation as compared to prior art technology.

Briefly stated the present invention provides an improved process for recovering tin values (cassiterite) from tin-bearing ores, ore concentrates or ore preconcentrates, including low grade, finely mineralized materials, by froth flotation of the tin values from aqueous tin-containing ore pulps which are optionally partially or completely deslimed. The process features conditioning such pulps with a first gangue and slime depressant, preferably a metal salt/silicate reagent combination, and a cassiterite collector highly selective to the flotation of cassiterite (i.e., collector other than fatty acid or fatty acid salt and exemplified by one or more of sulfosuccinamates, aspartates, phosphonates). Conventional conditions and equipment are used during this stage of the process. The expensive high energy conditioning considered essential in many prior art processes designed for use with finely mineralized ore pulps, including those containing cassiterite values, is not necessary.

The ore pulp thus conditioned is then subjected to rougher flotation at a mildly acidic to neutral pH, generally in the range of about 5 to 6, and higher than the pH of 2–3 heretofore considered necessary to secure optimum cassiterite flotation using highly selective specialized cassiterite collectors. Rougher flotation is carried out at ambient temperature or, preferably, the pulp is maintained at elevated temperature during the initial (rougher) flotation stages, the elevated temperature resulting from external heating of the pulp. Flotation impeller speeds are within the conventional range but, preferably, the speeds are higher. The cassiterite flotation concentrate thus produced (rougher concentrates) will contain a major portion of the cassiterite in the feed to the rougher flotation system, i.e., a high recovery of tin values will be realized. However, the rougher flotation concentrate will still contain gangue and waste minerals, the presence of which will result in a reduction in tin content (grade), as compared to the tin content of a concentrate in which less gangue and waste is present with the tin values. Gangue minerals are exemplified by all silicate minerals, silica, carbonates and various metal oxides. To remove the gangue from the rougher froth flotation concentrate on a selective basis (i.e., while minimizing losses of tin values during rougher flotation), the rougher concentrate is repulped with water and to the pulp there is added one or more of an additional (secondary) depressant, different from the depressant used in rougher flotation. Preferred secondary depressants include tannic acid, sulfuric acid, sodium fluorosilicate, sodium lignin sulfonate and activated charcoal. The pulp including the secondary depressant is then agitated (conditioned) and subjected to one or more cleaner froth flotation steps to float cassiterite selectively from gangue or slimes present with the cassiterite in the rougher flotation concentrate. pH values lower than about 5 to 6 may be found useful, particularly for the cleaning operations.

The foregoing operation for the treatment of cassiterite-containing ore, in accordance with the present invention, is illustrated in the accompanying drawings which is a flow sheet showing the treatment of a tin-bearing ore pulp as operated in a closed flotation circuit.

From the brief description of the present invention, it will be apparent that one feature resides in the use of highly selective water soluble collectors (e.g., sulfosuccinamates or aspartates) specifically designed for cassiterite collection in combination with a primary gangue depressant which is preferably a metal salt/silicate combination. Similar metal salt/silicate combinations have been described as depressants for a variety of flotation systems including cassiterite flotation, but, as a rule, the collectors were soaps based on oleic acid or tall oils and also undesirable high energy conditoning was usually required when treating finely mineralized or slimed ore pulps.

Another advantage accruing from the use of the metal salt/silicate depressant, not achieved by Patek (supra), is that in practice of the present invention the metal salt/silicate combination exhibits a pronounced depressing action on the slimes always present in cassiterite flotation pulps. This metal salt/silicate depressing action upon the slimes permits the use of various specific cassiterite collectors, which would otherwise be very sensitive to the presence of slimes. Thus, prior to this invention, only fatty acid soaps could be used for the flotation of slimed tin ores. Practice of the present invention obviates the need for desliming and consequently will substantially reduce or eliminate the losses of tin associated with the desliming step.

However, by no means should the progress of invention be construed as excluding desliming of any degree of thoroughness or at any particle size. The process of invention may indeed have application on any type of cassiterite pulp regardless of its slime content.

Another significant advantage of the invention is that it permits use of highly specific cassiterite collectors such as the sulfosuccinamates at moderately acidic pH values, such as pH values in the range of 5 to 6. This result was surprising and unexpected in view of the teachings of U.S. Pat. No. 3,469,693 relative to optimum pH values when using sulfosuccinamates in tin flotation.

Another advantageous and surprising departure of the present invention from prior art practice is the use of the secondary additional depressants and (secondary) additional conditioning step, whereby the sharpness of the separation of cassiterite from the gangue minerals is advantageously improved.

Other unexpected advantageous benefits are related to the improved cassiterite recoveries obtained when practicing the especially preferred embodiments of the invention utilizing pulp temperatures which are higher than those conventionally used during flotation.

The process of present invention also differs surprisingly and very advantageously from a method heretofore proposed for flotating tin from undeslimed flotation pulps. In contrast to the above mentioned method, the present invention does not require costly high energy agitation of the tin ore pulp to cause an increase in temperature prior to flotation. This represents an economic advantage of significant commercial benefit.

DESCRIPTION OF PREFERRED EMBODIMENTS

The practices of this invention will now be described in connection with preferred embodiments hereof.

The cassiterite ore flotation feed is subjected to a first or primary conditioning operation wherein a primary depressant is employed. The primary depressant employed in the first or primary conditioning operation is desirably a metal salt/silicate mixture, such as a sol (hydrosol) prepared by mixing a dilute aqueous solution of an alkali metal silicate such as sodium silicate and a dilute aqueous solution of a metal salt, e.g. a polyvalent metal salt, such as aluminum sulfate, lead nitrate, barium chloride, ferrous or ferric sulfates or chlorides, etc. The alkali silicate and metal salt may be mixed in the ratios from about 10:0.1 to about 10:4; preferably about 10:0.5 to about 10:2. The total dosage of the primary depressant reagent combination in the first or primary conditioning operation may vary from about several hundred grams to 10 kilograms per metric ton of the crude ore, i.e. the plant feed prior to the flotation removal of any sulfides therefrom. Desirably, this range will be between about 500 to about 5000 grams per metric ton of the crude ore. The time required for the conditioning operation employing the primary depressant will largely depend upon the nature of the ore and may range from about 1 to about 30 minutes but usually requires a conditioning time in the range 5–15 minutes.

Various amounts of pH modifiers, e.g. sulfuric acid or other mineral acids or sodium carbonate or other alkaline acting reagents, may be added to the primary conditioning operation to adjust the pH value of the aqueous pulp containing the cassiterite ore, such as to a pH in the range 4–7. The pH modifiers may be added either prior to or after the addition of the primary depressants, e.g., the metal salt/silicate combination.

Various amounts of a cassiterite collector, one or more, such as succinamate, sulfosuccinamate, aspartic acid, phosphonic acid, arsonic acid, hydroxamic acid, or their salts, along with conventional frothers, may be added to the primary conditioning operation after the addition of the metal salts/silicate primary depressant. The pH modifiers, cassiterite collector and frother may also be added just prior to the cassiterite froth flotation operation. The amounts of pH modifiers, depressant, etc., will usually vary depending upon the nature of the ore.

The amount of cassiterite collector will also vary with the nature of the ore and pulp and may range from about 50 to about 2000 grams per metric ton of the crude ore, preferably in the range about 200 to 600 grams per metric ton of the crude ore.

After the primary conditioning step, the conditioned plup is subjected to a rougher flotation step. Additional amounts of the pH modifier, collector and frother may be required at this stage for the purpose of obtaining and maintaining satisfactory flotation.

The cassiterite rougher flotation is carried out in the pH range of about 4 to 7, preferably about 5 to 6. The duration of the rougher flotation operation is usually determined by the nature of the ore. The cassiterite rougher flotation may be carried at ambient temperature or at an elevated pulp temperature, such as at a pulp temperature as high as 50° C. or even higher. The flotation temperature, as indicated, will depend on the nature of the ore and economic circumstances and is usually in the range of about 15° C.–30° C.

The rougher flotation is advantageously carried out while employing flotation machine impeller speeds higher than conventional. Impeller peripheral speeds as high as 1650 ft./min. beneficially affect the flotation of very fine cassiterite particles, thus reducing the tin losses in rougher tails and increasing the overall tin recovery. Close control of frother addition and air intake into the flotation pulp may be necessary when high flotation machine impeller speeds are employed.

The cassiterite rougher flotation step yields two products (i) froth which is rich in cassiterite and which represents cassiterite rougher concentrate and (ii) flotation machines' underflow from which cassiterite is removed and which represents tails or waste. The rougher concentrate or cassiterite-rich froth is then subjected to the second or secondary conditioning step prior to the flotation cleaning operation.

The secondary depressant employed in the second or secondary conditioning operation is different from that employed in the primary conditioning operation. The purpose of the depressants, as indicated hereinabove, is to depress waste minerals without affecting the flotation of cassiterite particles. The secondary depressant used may be:

(i) sulfuric acid or any other mineral acid
(ii) tannic acid, its salts and quebracho or other natural products containing tannin
(iii) hydrofluoric or fluorosilicic acids or salts thereof, such as sodium silico fluoride
(iv) sodium ligno sulfonates or lignin sulfonates
(v) activated charcoal.

All of the above secondary depressants, with the exception of the mineral acids, are usually added in the range of about 10 to 1000 grams per metric ton of the crude ore, preferably in the range of between about 50 and 400 grams per metric ton of crude ore. Mineral acids, including sulfuric acid, should be added in such amounts as to lower the pH value of the cassiterite rougher flotation concentrate pulp below pH 6, preferably in the range about 3.5–5.5. The conditioning time with secondary depressants may vary from about one minute to about 30 minutes, more or less, usually about 5–15 minutes. The pH modifiers, cassiterite collectors (10–100 g./mt. crude ore) and frothers (1–50 g./mt. crude ore) may be added with or after the secondary depressants.

Upon the completion of the secondary conditioning, the conditioned cassiterite rougher concentrate is subjected to the cleaner flotation step. The purpose of the latter is to produce a cassiterite flotation concentrate (froth) richer in tin content than the feed to this step. The cassiterite cleaner flotation tail (machines' underflow) may be returned to any point of the treatment circuit as it is found to be most beneficial for the given ore (closed circuit) or, if low in values, it may be excluded from the further treatment and rejected as waste (open circuit).

The cleaner operation may be repeated as many times as necessary and until the desired grade of the cassiterite concentrate is reached.

During the various cleaning stages, additional amounts of pH modifiers, cassiterite collectors and frothers may be required and could be added in one or more stages in the amounts similar to those described above for the secondary conditioning step.

The following examples are given primarily to illustrate practice of the invention and to point out some advantages thereof. The invention is not to be construed as being limited to the specific reagent and operating conditions used in these examples but may be varied within the scope of the invention.

The cassiterite ores used in the tests described in the illustrative examples are designated Ore A, Ore B and Ore C. The make up of each of these ores is set forth hereinbelow.

Ore A contains more than 95% of the tin as cassiterite. The cassiterite occurs as clusters of $SnO_2$ (up to about 200 micron size) and also an intimate association with sulfides (less than 10 micron size). A small amount of the tin is present as tin sulfide. The major sulfide minerals in the ore are the sulfides of lead, zinc and iron. The major non-sulfide, gangue minerals in the ore are quartz, carbonates (calcite, dolomite or siderite), clay and goethite.

Ore A, containing 1.05% Sn, was ground to 98% minus 100 mesh, or 68% minus 200 mesh, or 41% minus 400 mesh (Tyler) so as to liberate or free the minerals therein from each other prior to the separation by flotation.

Ore B contains cassiterite as the only significant tin mineral. The cassiterite occurs as grains and clusters smaller than 150 microns and is intimately associated with iron oxide minerals. To a smaller extent, the cassiterite is also associated with quartz. The ore also contains about 2 to 4% pyrite as the only significant sulfide mineral. The other gangue minerals present in the ore are iron oxides (hematite, limonite, goethite), quartz, muscovite, tourmaline, sericite, chlorite, and zircon, in this order of decreasing abundance.

Ore B, containing 1.18% Sn, was ground to 100% minus 100 mesh, or 96% minus 200 mesh, or 54% minus 400 mesh (Tyler) to liberate the minerals therein prior to flotation separation.

Ore C contains cassiterite as the only significant tin mineral. The cassiterite occurs as grains and clusters smaller than 150 microns and is intimately associated with sulfides. To a smaller extent, the cassiterite is also associated with silicates. Pyrrhotite is the major sulfide mineral in the ore ranging from 20 to 50% by weight. Pyrite, arsenopyrite, and some copper sulfides are present in minor amounts. The non-sulfide gangue minerals are mainly represented by silicates, siderite, calcite, dolomite and various carbonate alteration products, such as talc, tremolite and actinolite.

Ore C, containing 1.45% Sn, was wet ground in a laboratory rod mill to 100% minus 100 mesh, or 90% minus 200 mesh, or 56% minus 400 mesh (Tyler) prior to flotation in accordance with the practices of this invention.

Tests were carried out to demonstrate the effectiveness of the practices of this invention. The test procedures are set forth hereinafter along with the test results. The ores were ground wet in a laboratory rod mill to yield size distributions given under description of ores. The sulfide minerals were floated off with xanthates or other suitable and conventional sulfide mineral collectors.

The sulfide flotation tails were thickened when necessary, by settling or by means of a hydrocyclone to reach pulp density of 18 to 25% solids.

The sulfide flotation tail was conditioned (Denver D-1 Laboratory Flotation Machine, 2 lit. cell) at 18 to 25% solids pulp density for 10 minutes with metal salt/silicate primary depressant, the types and dosages of which are shown in examples. The metal salt/silicate primary depressant (hydrosol) was prepared by mixing a dilute (1 wt.%) aqueous solution of metal salt with a dilute (5 wt.%) aqueous solution of commercial sodium silicate ($SiO_2/Na_2O$ of about 3.3) containing about 37% sodium silicate. Collector and frother were added as shown in the test examples and conditioned with the pulp for about 30 seconds each.

The cassiterite rougher flotation was carried out for 8 to 12 minutes. Pulp pH was adjusted to the pH range from 5.3 to about 5.7 if necessary. Small amounts of cassiterite collector and frother were added if required. The pulp temperature was maintained between 24° and 30° C., if not shown otherwise. The impeller peripheral speed was maintained at about 1400 ft./min. if not shown otherwise in the test examples. The froth was removed mechanically at a constant rate for the duration of the rougher flotation step. The air intake of the flotation machine was controlled by means of a valve and monitored by a flowmeter.

The cassiterite rougher flotation concentrate (froth) was subjected to the secondary conditioning with secondary depressants of which the types and dosages are shown in examples, if applicable.

The secondary conditioning was carried out for 10 minutes, without allowing air into the conditioned pulp.

After the completion of the secondary conditioning various amounts of pH modifier, usually sulfuric acid, along with collector (25 to 50 g./mt.) and frother (5–25 g./mt.) were added. The cleaner flotation duration was from 4 to 8 minutes.

The cassiterite cleaner (froth) concentrate was subjected to the recleaner flotation step essentially similar to the flotation cleaner step, except that conditioning with depressants was omitted.

Upon completeion of the tests, the products were filtered, dried, weighed, sampled, pulverized and assayed in accordance with the practice established in metallurgical laboratories. The results of these tests are set forth in table form.

Unexpected advantages of the process of the invention over prior art systems proposed or used are evident from data in Table 1. For example, the results of Tests No. 4 and 5 in Table 1, reflect data for practice of this invention extrapolated for recovery of a cleaner tin concentrate at 9% Sn assay for undeslimed and partially deslimed ore. The data shows more than 400% higher recovery of tin was realized in Tests No. 4 and No. 5 than in Test No. 1 embodying the flotation system of U.S. Pat. No. 3,469,693 with partially deslimed ore and using the same sulfosuccinamate collector employed in Tests 4 and 5 as well as the same depressant in the cleaner flotation circuit but at the optimum pH range disclosed in the patent. Data in Table 1 demonstrates the high recovery (52.5–55.5%) of tin values when the process of the invention was applied to both undeslimed and partially deslimed tin ore feed, whereas the prior art process resulted in only 12% Sn recovery even when the feed was partially deslimed. A comparison of results of Test No. 5 and Test No. 2, both using a salt/silicate combination and moderate agitation during rougher conditioning to depress gangue in undeslimed feed shows that the present process utilizing a highly specific tin collector at mildly acidic pH was markedly superior to fatty acid collector at conventional pH for use of the fatty acid reagent.

Results for Test No. 3 in Table 1 demonstrates the importance of using a metal salt/silicate primary depressant in rougher conditioning. All other variables being essentially the same, 50% more tin was recovered in Test No. 5 than in Test No. 3.

Data in Table 2 demonstrate the effectiveness of various cassiterite collectors for the proposed system of treatment. On the other hand, data in Tables 3 and 4 show the benefit of using various additional (secondary) depressants to improve grades of cassiterite flotation concentrates obtained from two different ones using the present novel system of reagents.

Tests carried out with Ore A (not reported in the tables) showed surprisingly beneficial effect on cassiterite recovery caused by higher flotation machine impeller speed, in particular speeds of 1350 ft./min. and above. Other tests with Ore B showed the surprisingly beneficial effect of elevating rougher flotation pulp temperature by external heating during flotation; in particular, the tests demonstrated the desirability of carrying out rougher flotation at 27°–30° C., and especially 40°–50° C., to achieve high recovery of tin at acceptable tin grades.

From the description of the present invention and the illustrative examples above, it is evident that there is now provided a simple and inexpensive, yet efficient and practical system for recovering cassiterite by froth flotation from pulps of finely mineralized low grade tin ores. It has been demonstrated that such process is operative with undeslimed and partially deslimed ore pulp, to achieve noteworthy high recovery of very fine tin particles, lost and rejected in present flotation practice. It has further been shown that the process of present invention is effective without need to use costly high energy input during conditioning and that mildly acidic flotation circuits provide outstanding results in terms of tin grade and recovery, while the former need to use strongly acidic pulps to achieve high grade and recovery is obviated.

TABLE 1

ORE TYPED: A
COMPARISON OF CASSITERITE FLOTATION PROCESS
OF THE INVENTION AND PRIOR ART FLOTATION SCHEMES

| Depressant in Rougher | | Test Conditions | | | | | | Test Results |
|---|---|---|---|---|---|---|---|---|
| Test No. | Metal Salt g/mt | Sodium Silicate g/mt | Collector g/mt | Frother AF-65 g/mt | Desliming | Flotation Pulp pH | Depressant in Cleaner g/mt | Recovery at 9% Sn Assay |
| 1 | None | None | CA540,350 | 10 | Partial | 2.3–2.5 | $Na_2SiF_6$,200 | 12 |
| 2 | $Al_2(SO_4)_3 \cdot 18H_2O$,150 | 1500 | Oleic Acid,250 | " | None | 7.3–7.5 | None | 0 |
| 3 | None | None | CA540,350 | " | Partial | 5.5–6.5 | DA-811 | 35 |
| 4 | $Al_2(SO_4)_3 \cdot 18H_2O$,150 | 1500 | " | 15 | None | 5.5–6.3 | $Na_2SiF_6$,200 | 52.5 |
| 5 | " | " | " | " | Partial | 5.5–6.4 | " | 55.5 |

Test 1, process in accordance to U.S. 3,469,693.
Test 2, process of J. M. Patek (Soap Flotation, EMJ, March 1934, p. 125.
Test 3, process in accordance to U.S. 3,469,693 and U.K. 1,452,605.
Test 4, process of present invention - undeslimed ore pulp.
Test 5, process of present invention - partially deslimed ore pulp.
A-65, frother, high molecular weight polyglycol manufactured by American Cyanamid Co.
CA-540, collector, an N-alkyl Sulfosuccinamate manufactured by Allied Colloids Ltd., U.K.

TABLE 2

ORE TYPE: A
COMPARISON OF VARIOUS SPECIFIC CASSITERITE COLLECTORS IN PRACTICE OF PROCESS OF THE PRESENT INVENTION

| Depressant in Rougher | | Test Conditions | | | | | | Test Results |
|---|---|---|---|---|---|---|---|---|
| Test No. | Metal Salt g/mt | Sodium Silicate g/mt | Collector g/mt | Frother AF-65 g/mt | De-sliming | Flotation Pulp pH | Depressant in Cleaner g/mt | Recovery at 9% Sn Assay |
| 1 | $Al_2(SO_4)_3 \cdot 18H_2O$,150 | 1500 | CA540,350 | 15 | partial | 5.6-6.4 | $Na_2SiF_6$,200 | 57 |
| 2 | " | " | P-195,450[1] | 20 | " | 4.8.-6.1 | " | 46.5 |
| 3 | " | " | S-3903,450[2] | " | " | 5.5-5.9 | " | 55 |
| 4 | " | " | AP-845,350[3] | 15 | " | 5.3-6.5 | " | 60 |

[1]Phosphonic Acid manufactured by Hoechst AG, West Germany (sodium salt)
[2]Sodium salt of Aspartic Acid manufactured by American Cyanamid Co., U.S.A.
[3]Alkyl sulfosuccinamate manufactured by American Cyanamid Co., U.S.A.

TABLE 3

ORE TYPE: A
EFFECT OF COMPOSITION OF SECONDARY DEPRESSANT ON CLEANER CASSITERITE FLOTATION

| Depressant in Rougher | | Test Conditions | | | | | | Test Results |
|---|---|---|---|---|---|---|---|---|
| Test No. | Metal Salt g/mt | Sodium Silicate g/mt | Collector CA540 g/mt | Frother AF-65 g/mt | Desliming | Flotation Pulp pH | Depressant in Cleaner g/mt | Recovery at 9% Sn Assay |
| 1 | $Al_2(SO_4)_3 \cdot 18H_2O$,250 | 2500 | 250 | 30 | Partial | 5.6-7.2 | None | 0 |
| 2 | $Al_2(SO_4)_3 \cdot 18H_2O$,150 | 1500 | 300 | 15 | " | 5.6-6.3 | Tannic Acid,100 | 55.5 |
| 3 | " | " | 350 | " | " | 5.6-6.4 | $Na_2SiF_6$,200 | 57 |
| 4 | " | " | " | " | " | 5.6-6.5 | Sodium Lignin Sulfonate, 100 | 57 |
| 5 | " | " | " | " | " | 5.5-6.1 | $H_2SO_4$,250 | 60 |
| 6 | " | " | 500 | 25 | " | 5.5-6.1 | Activated Charcoal,400 | 60 |

TABLE 4

ORE TYPE: C
EFFECT OF VARIATION OF SECONDARY DEPRESSANT ON CLEANER CASSITERITE FLOTATION

| Depressant in Rougher | | Test Conditions | | | | | | Test Results |
|---|---|---|---|---|---|---|---|---|
| Test No. | Metal Salt g/mt | Sodium Silicate g/mt | Collector CA540 g/mt | Frother DF250 g/mt | Flotation Pulp pH | Depressant in Cleaner g/mt | Desliming | Recovery at 16% Sn Assay |
| 1 | $Al_2(SO_4)_3 \cdot 18H_2O$,200 | 2000 | 500 | 10 | 5.4-6.2 | None | None | 0 |
| 2 | $Al_2(SO_4)_3 \cdot 18H_2O$,150 | 1500 | " | None | 4.3-6.3 | $Na_2SiF_6$,300 | " | 0 |
| 3 | " | " | 575 | " | 5.4-5.9 | Tannic Acid,200 | " | 86 |
| 4 | " | " | 450 | 50 | 5.1-6.5 | Tannic Acid,100 | Partial | 86 |
| 5 | " | " | 400 | " | 4.1-6.7 | $Na_2SiF_6$,250 | " | 91 |

I claim:

1. A process for the recovery of cassiterite from an ore, ore concentrate or ore preconcentrate by froth flotation of cassiterite from gangue and optionally slimes, which comprises forming said ore, ore concentrate or ore preconcentrate into an aqueous flotation pulp, conditioning said pulp with a first depressant for gangue and, optionally slimes that may be present, said first depressant comprising aluminum sulfate and sodium silicate, subjecting the resulting conditioned pulp to rougher froth flotation in the presence of one or more collector reagents selected from the group consisting of sulfosuccinamate, phosphonic acid, aspartic acid, arsonic acid, hydroxamic acid and salts of these acids at a pH ranging from mildly acidic to neutral, thereby producing a rougher flotation concentrate containing cassiterite along with gangue and optionally slimes, recovering rougher flotation concentrate and conditioning it with at least one second depressant selected from the group consisting of tannic acid, activated charcoal, sodium fluorsilicate, sodium lignin sulfonate, lignin sulfonate and quebracho, subjecting the resulting pulp to at least one cleaner froth flotation operation employing the same type of collector as said rougher froth flotation operation to float cassiterite selectively, and recovering the resulting cleaner flotation concentrate or concentrates now having a substantially reduced amount of gangue and optionally slimes associated therewith.

2. The process of claim 1 wherein said ore, concentrate or pre-concentrate is obtained from a low grade, finely mineralized ore.

3. The process of claim 1 wherein all conditioning is carried out in conventional equipment under conventional conditions of energy input.

4. The process of claim 1 wherein said conditioned pulp is heated externally during rougher flotation.

5. The process of claim 1 wherein said pulp is not deslimed before rougher flotation.

6. A process in accordance with claim 1 wherein said pulp is partially deslimed before rougher flotation.

7. A process in accordance with claim 1 wherein ore pulp is essentially deslimed before rougher flotation.

8. A process in accordance with claim 1 wherein said rougher froth flotation operation is carried out at a pH in the range of from about 4.0 to about 7.0.

9. A process in accordance with claim 1 wherein a major amount of weight of said cassiterite ore, ore concentrate or ore preconcentrate has a particle size less than 100 mesh Tyler.

10. A process in accordance with claim 1 wherein said collector is a sulfosuccinamate and rougher flotation is carried out at a pH in the range of from about 5 to about 6.

11. A process in accordance with claim 1 wherein said pulp that is subjected to said rougher flotation is obtained from a finely mineralized tin ore assaying less than 2 wt. % $SnO_2$ and at least about 50 wt. % of the tin is recovered at a grade of at least 9% Sn.

12. A process for the recovery of cassiterite from an ore, ore concentrate or ore preconcentrate by froth flotation of cassiterite from gangue and optionally slimes, which comprises forming said ore, ore concentrate or ore preconcentrate into an aqueous flotation pulp, conditioning said pulp with a first depressant for gangue, and, optionally slimes that may be present, said first depressant comprising a hydrosol prepared by mixing a dilute aqueous solution of a polyvalent metal sulfate and a dilute aqueous solution of sodium silicate, subjecting the resulting conditioned pulp to rougher froth flotation in the presence of one or more collector reagents selected from the group consisting of sulfosuccinamate, phosphonic acid, aspartic acid, arsonic acid, hydroxamic acid and salts of thse acids, at a pH ranging from mildly acidic to neutral, thereby producing a rougher flotation concentrate containing cassiterite along with gangue and optionally slimes, recovering rougher flotation concentrate and conditioning it with at least one second depressant selected from the group consisting of tannic acid, activated charcoal, sodium fluorosilicate, sodium lignin sulfonate, lignin sulfonate and quebracho, subjecting the resulting pulp to at least one cleaner froth flotation operation using the same type of collector employed in the rougher flotation operation to float cassiterite selectively, and recovering the resulting cleaner flotation concentrate or concentrates now having a substantially reduced amount of gangue and optionally slimes associated therewith.

* * * * *